US009689090B2

(12) United States Patent
Loos et al.

(10) Patent No.: US 9,689,090 B2
(45) Date of Patent: Jun. 27, 2017

(54) OPEN-END SPINNING ROTOR WITH A ROTOR CUP, A ROTOR SHAFT AND A COUPLING DEVICE

(71) Applicant: Maschinenfabrik Rieter AG, Winterthur (CH)

(72) Inventors: Bernd Loos, Deggingen (DE); Hans Kustermann, Böhmenkirch-Steinenkirch (DE)

(73) Assignee: Maschinenfabrik Rieter AG, Winterthur (CH)

( * ) Notice: Subject to any disclaimer, the term of this patent is extended or adjusted under 35 U.S.C. 154(b) by 399 days.

(21) Appl. No.: 14/446,956

(22) Filed: Jul. 30, 2014

(65) Prior Publication Data

US 2015/0033695 A1 Feb. 5, 2015

(30) Foreign Application Priority Data

Jul. 31, 2013 (DE) ..... 10 2013 108 199

(51) Int. Cl.
*D01H 4/10* (2006.01)
*D01H 4/12* (2006.01)

(52) U.S. Cl.
CPC ..... *D01H 4/10* (2013.01); *D01H 4/12* (2013.01)

(58) Field of Classification Search
CPC ..... D01H 4/10
See application file for complete search history.

(56) References Cited

U.S. PATENT DOCUMENTS 4,319,449 A * 3/1982 Hofmann ..... D01H 4/10 57/404
5,526,638 A * 6/1996 Bock ..... D01H 4/10 57/404
5,555,715 A * 9/1996 Paweletz ..... D01H 4/10 310/86
5,634,326 A * 6/1997 Wanger ..... D01H 4/12 384/107
5,637,941 A * 6/1997 Paweletz ..... D01H 4/10 310/90.5
5,802,838 A 9/1998 Bock
(Continued)

FOREIGN PATENT DOCUMENTS

DE 38 15 182 A1 11/1989
DE 103 26 849 A1 12/2004
EP 2 463 415 A2 6/2012

OTHER PUBLICATIONS

German Patent Office Search Report, Mar. 31, 2014.
EP Search Report, Dec. 4, 2014.

*Primary Examiner* — Shaun R Hurley
(74) *Attorney, Agent, or Firm* — Dority & Manning, P.A.

(57) ABSTRACT

In an open-end spinning rotor with a rotor cup, and with a rotor shaft, through which the spinning rotor is supported in a bearing, the rotor shaft and the rotor cup are detachably connected to each other through a coupling device. The coupling device includes a positive-locking connection for the transmission of the turning moment between the rotor cup and the rotor shaft, along with a magnetic device for the axial connection of the rotor shaft and the rotor cup. The rotor shaft features at least one projection with a one turning moment-transmitting area, which engages in a recess of the rotor cup with a turning moment-transmitting counter-area. A socket for a permanent magnet is arranged on the rotor cup.

27 Claims, 4 Drawing Sheets

(56) References Cited

U.S. PATENT DOCUMENTS

| | | | | |
|---|---|---|---|---|
| 5,832,711 | A | 11/1998 | Baumgartner | |
| 6,863,466 | B2 | 3/2005 | Bühren | |
| 7,605,509 | B2 * | 10/2009 | Buhren | D01H 4/14 310/156.08 |
| 2002/0006830 | A1 * | 1/2002 | Buhren | D01H 4/10 464/29 |
| 2007/0234857 | A1 | 10/2007 | Kozak et al. | |
| 2009/0084081 | A1 * | 4/2009 | Wassenhoven | D01H 4/10 57/404 |
| 2010/0062922 | A1 | 3/2010 | Hoffmann | |
| 2013/0283754 | A1 * | 10/2013 | Wassenhoven | D01H 4/10 57/406 |
| 2015/0233025 | A1 * | 8/2015 | Wassenhoven | D01H 4/10 57/407 |

* cited by examiner

OPEN-END SPINNING ROTOR WITH A ROTOR CUP, A ROTOR SHAFT AND A COUPLING DEVICE

FIELD OF THE INVENTION

The present invention relates to an open-end spinning rotor with a rotor cup, in which a fiber material is able to be spun, and with a rotor shaft, through which the spinning rotor is able to be supported in a bearing, in particular a magnetic bearing. The rotor shaft and the rotor cup are detachably connected to each other through a coupling device. The coupling device includes a positive-locking connection for the transmission of the turning moment between the rotor cup and the rotor shaft along with a magnetic device for the axial connection of the rotor shaft and the rotor cup.

BACKGROUND

In the production of yarns in open-end spinning machines, it is necessary to, depending on the type of the fiber material to be spun and depending on the type of the desired yarn to be manufactured, use different spinning rotors or spinning rotors with different rotor cups, since the shape and the design of the rotor cups of the spinning rotor have a significant effect on the spinning result. Given the permanent contact with fiber, the rotor cups of spinning rotors in open-end spinning machines are also subjected to significant wear, and therefore must be replaced. Depending on the structure of the open-end spinning device and the bearing of the spinning rotor, the replacement of the spinning rotors can be associated with a significant effort, such that spinning rotors are often provided with a coupling device for replacing the rotor cup. Particularly in open-end spinning devices in which the rotor shaft is mounted in a magnetic bearing, the installation or removal of the complete spinning rotor is expensive, such that spinning rotors with a coupling device are typically employed.

DE 38 15 182 A1 describes a spinning rotor with such a coupling arrangement. Thereby, DE 38 15 182 A1 provides for arranging a coupling shell with a recess or a sleeve at the end of the rotor shaft; a corresponding complementary designed pin, which is arranged on the reverse side at the bottom of the rotor pot, engages in this. The transmission of the turning moment from the rotor shaft to the rotor pot should thereby take place through a positive-locking connection of both coupling parts with each other. According to a second embodiment, in place of a large, central pin, several smaller pins that engage in recesses of the coupling shell can also be provided. A permanent magnet, which is inserted into the coupling disk on the rotor shaft, is used to hold the rotor pot. The coupling arrangement is relatively costly to produce, and also relatively large and heavy, which is disadvantageous with today's high rotational speeds.

EP 1 156 142 B1 shows a spinning rotor that is already provided with a magnetic bearing arrangement for an open-end spinning device. The coupling device includes a shaft sleeve arranged on the shaft of the spinning rotor, in which an internal hex is arranged. A cylindrical guiding collar is formed on the rotor cup as a coupling device; this engages in the shaft sleeve of the rotor shaft. In the extension of the cylindrical guiding collar, there is an external hex that engages in the internal hex in the shaft sleeve of the rotor shaft. Behind the shaft sleeve of the rotor shaft, which includes the internal hex, a permanent magnet is likewise arranged within the rotor shaft; this is to take over the axial securing of the coupling device. The production of the spinning rotor with the additional guiding collar and the additional shaft sleeve is likewise relatively expensive.

SUMMARY OF THE INVENTION

A task of the present invention is to propose an open-end spinning rotor with a coupling device that features a simple and low-maintenance structure. Additional objects and advantages of the invention will be set forth in part in the following description, or may be obvious from the description, or may be learned through practice of the invention.

With an open-end spinning rotor with a rotor cup, a rotor shaft and a coupling device, by means of which the rotor shaft and the rotor cup are detachably connected to each other, the coupling device includes a positive-locking connection for the transmission of the turning moment and a magnetic device for the axial connection of the rotor shaft and the rotor cup. It is now provided that the coupling device is arranged with its two coupling components directly at the rotor shaft or the rotor cup without the interposition of additional components. The assembly of the open-end spinning rotor is thereby particularly simple, as only two parts of the rotor shaft and the rotor cup must be connected to each other and, if applicable, the permanent magnet must still be used. In addition, it is thereby possible to provide a coupling device with a very low weight, which requires no additional space requirement. Therefore, in particular, the open-end spinning rotor is advantageously able to be used in open-end spinning devices with high rotational speeds of over 130,000 RPM (revolutions per minute).

As a coupling device, the rotor shaft features at least one projection with at least one turning moment-transmitting area, which engages in at least one recess of the rotor cup corresponding to it with at least one turning moment-transmitting counter-area. A socket for a permanent magnet is arranged on the rotor cup, in particular in the rotor bottom of the rotor cup. Given that the permanent magnet is arranged on the rotor cup, it is possible in a particularly simple and advantageous manner to remove this after the expiration of its service life and replace it with a new permanent magnet. A complex disassembly of the rotor shaft from the bearing of the open-end spinning device is not required for this.

If the socket for the permanent magnet is located directly in the bottom of the rotor cup, the permanent magnet is particularly accessible and easily interchangeable. With this arrangement, it is also particularly advantageous that the permanent magnet is located on the wear part of the spinning rotor (i.e., the rotor cup), which in any event must be replaced after a certain period of time. It has been shown that such magnets often have relatively short service lives, and therefore must be replaced. This is now possible, without any problem, through the arrangement of the permanent magnet on or in the easily replaceable rotor cup, since the magnet is easily accessible.

Particularly good accessibility, and thus a particularly easy replacement of the permanent magnet, arises when such permanent magnet is arranged in an axial extension of the recess for the projection of the rotor shaft. At the same time, this also gives rise to a particularly good axial connection between the rotor shaft and the rotor cup.

A simple production and a simple assembly of the open-end spinning rotor are enabled if the socket for the permanent magnet is formed through a bore hole in the rotor cup. Preferably, one such bore hole is located in the bottom of the rotor cup, such that the permanent magnet can be easily inserted from the opening of the rotor cup into the socket. Yet, it is also possible to arrange one or more permanent magnets within the truss of the rotor cup in such a manner that, with an assembled spinning rotor, they lie next to the projection of the rotor shaft. For example, a ring-shaped permanent magnet can also be arranged in the truss of the rotor cup; with an assembled spinning rotor, this surrounds the projection of the rotor shaft.

According to an advantageous embodiment of the invention, the at least one projection of the rotor shaft features at least one cylindrical outer contour at its end turned towards the rotor cup. Thereby, a good centering of the rotor cup at the rotor shaft can be achieved, and imbalances can be avoided.

According to an additional embodiment of the invention, the at least one projection of the rotor shaft features one elliptical outer contour, at least in sections. Accordingly, the projection of the rotor shaft may either feature an elliptical outer contour over its entire length or feature only one section with one elliptical outer contour. In this case, the elliptical outer contour forms the at least one turning moment-transmitting area.

According to an advantageous further modification of the invention, the at least one projection of the rotor shaft includes a first section turned towards the rotor cup and a second section turned towards its shaft end, which is turned away from the rotor cup. The section turned towards the shaft end thereby includes the at least one turning moment-transmitting area, which may be formed as, for example, a turning moment-transmitting surface or edge. By dividing the projection into two or more sections, it is possible to assign each of these sections to its own task; thus, for example, to provide one or more turning moment-transmitting areas at one section and to undertake the centering of the rotor shaft at the rotor cup through an additional section. Likewise, one of the sections can be used for the connection of the rotor cup with the rotor shaft.

It is also advantageous if the at least one projection or one section of the at least one projection of the rotor shaft features at least one groove, which includes the at least one turning moment-transmitting area. In terms of production technology, this can be made in an advantageous manner by milling.

It is particularly advantageous if the second section includes a width across flats or an elliptical outer contour. This in turn forms the turning moment-transmitting area, here in the form of a turning moment-transmitting surface. If the second section contains a width across flats, both the width across flats on the second section of the projection and the corresponding counter-area and/or counter-surface on the rotor cup can be produced in a particularly simple manner. However, it is also possible to provide only one turning moment-transmitting area on the second section.

It is also advantageous if the first section features a cylindrical outer contour. Using the cylindrical outer contour, a centering can be undertaken in a simple manner. In addition, through this, the rotor shaft may at the same time be fastened in the rotor cup, for example through a press fit.

It is also advantageous for the production and the assembly of the spinning rotor if the at least one recess of the rotor cup includes a through hole, in particular a cylindrical through hole. It is thereby particularly advantageous if the socket for the permanent magnet is arranged in the cylindrical through hole or is formed directly by the cylindrical through hole. At the same time, a particularly good axial stop can be achieved through this, since, with a mounted spinning rotor, the projection of the rotor shaft and the permanent magnet can come into direct contact. However, depending on the embodiment of the projection on the rotor shaft, the through hole may also be designed in elliptical or oval form. In this case, the inner, elliptical or oval lateral surface of the through hole forms the at least one turning moment-transmitting counter-surface or the at least one turning moment-transmitting counter-area.

According to an additional embodiment of the invention, it is advantageous if the at least one recess of the rotor cup includes a first, in particular cylindrical, section, in which the first section of the projection of the rotor shaft engages, along with a second section, which contains the at least one turning moment-transmitting counter-area and operates in conjunction with the first section of the projection of the rotor shaft. With this embodiment, it is particularly advantageous that, as already described, different functions may be assigned to different sections. The turning moment-transmitting surfaces or areas, which always differ from the cylindrical shape, may be formed with such a large size that a good transmission of the turning moment is enabled, but, on the other hand, may be formed relative to the longitudinal axis of the spinning rotor with such a small size that significant imbalances are not produced in the spinning rotor. Of course, such an embodiment is possible not only with two sections of the projection of the rotor shaft or with two sections of the recess of the rotor cup. Three or more sections can also be provided. Thereby, the at least one turning moment-transmitting area or counter-area need not necessarily be arranged on the first section turned away from the rotor cup.

It is particularly advantageous if the second section of the recess is arranged on the reverse side of the rotor cup on the truss of the rotor cup.

It is also advantageous if the second section of the recess includes at least one groove, which preferably extends across the entire width of the truss of the rotor cup. Thereby, the production of the rotor cup or the spinning rotor is possible in a particularly simple manner by milling the groove or grooves.

It is also advantageous if the permanent magnet can be clipped into the socket, in particular into the through hole, of the rotor cup. This further supports the simple replacement and the simple assembly.

In addition, it is advantageous if the permanent magnet features a plastic lining cover. Through this, in a particularly simple manner, the permanent magnet can be fixed by means of the plastic lining cover in the socket. Thereby, due to the elasticity of the plastic lining cover, not only a clamping of the permanent magnet into its socket, but also a partially positive-locking stop, can be achieved.

In addition, it is advantageous if the rotor shaft and/or the rotor cup features a stop surface for the axial positioning of the rotor shaft in relation to the rotor cup. This further simplifies the assembly of the spinning rotor.

It is also advantageous if the shaft end arranged on the projection of the rotor shaft forms a support surface for the permanent magnet. After the assembly of the spinning rotor, only the permanent magnet from the side of the rotor bottom may still be introduced into the through hole of the rotor cup, and is automatically correctly positioned after stopping on the support surface of the projection.

Advantageously, the rotor shaft, at least in the area of its projection, consists of a ferromagnetic material.

BRIEF DESCRIPTION OF THE DRAWINGS

Additional advantages of the invention are described on the basis of the following embodiments. The following is shown.

DETAILED DESCRIPTION

Figure 1:
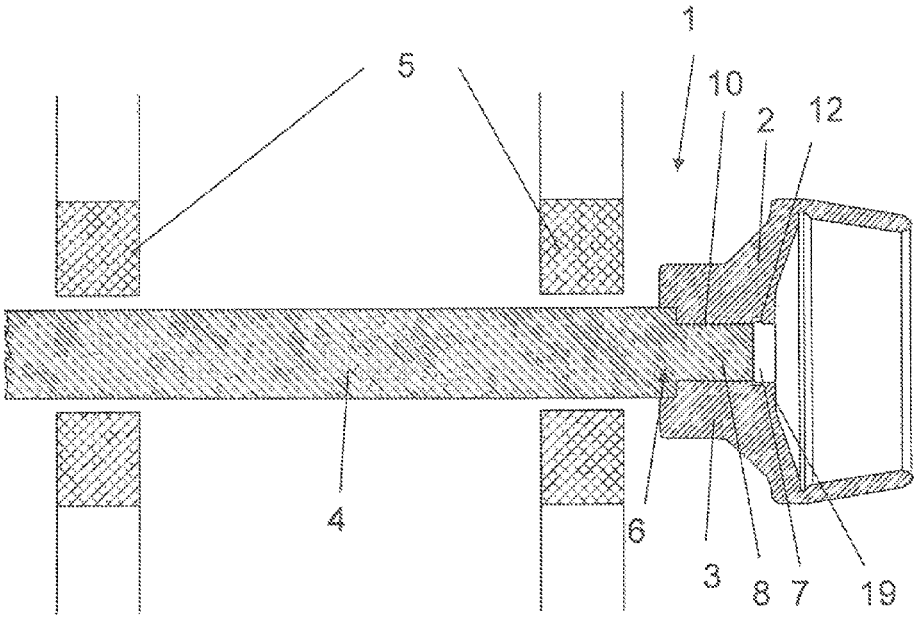
FIG. 1 a spinning rotor in accordance with the invention with a coupling device between the rotor shaft and the rotor cup in a schematic sectional presentation, FIG. 2 a projection on the shaft end of a rotor shaft according to a first embodiment, FIGS. 3 and 4 a rotor cup with a recess for a projection of the rotor shaft, FIG. 5 an additional embodiment of a projection on a rotor shaft, FIG. 6 an additional alternative embodiment of a projection on a rotor shaft, FIG. 7 a detailed presentation of a coupling device in a schematic cross-section, FIG. 8 an additional embodiment of a rotor cup with a recess for a projection of the rotor shaft and a ring magnet, FIG. 9 an additional alternative embodiment of a rotor cup with a recess for a polygonal projection of the rotor shaft, along with FIG. 10 a presentation of an additional coupling device in a perspective view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows an open-end spinning rotor 1 in a bearing 5 in a schematic, cut-out overview presentation. According to this presentation, the spinning rotor 1 is supported in a magnetic bearing arrangement as a bearing 5 at each of the two bearing locations. The open-end spinning rotor 1 is rotatably mounted in the bearing 5, and is powered by an electric motor that is not shown. However, it is also possible to arrange an open-end spinning rotor 1 in accordance with the invention in a conventional bearing 5 with support disks. An axial bearing of the open-end spinning rotor 1, which may be formed, for example, as a magnetic bearing, is also not shown.

The open-end spinning rotor 1 includes a rotor cup 2 along with a rotor shaft 4, which, through a coupling device 6, includes a positive-locking connection (not shown in this presentation) for the transmission of the turning moment between the rotor cup 2 and the rotor shaft 4, along with a permanent magnet 7 for the axial connection of the rotor shaft 4 and the rotor cup 2. Thereby, the positive-locking connection for the transmission of the turning moment is formed directly on the rotor shaft 4 or the rotor cup 2, such that they are directly connected to each other in a particularly advantageous manner, without any additional components. The rotor shaft 4 thereby includes a projection 8 with at least one turning moment-transmitting area 9 (for example, see FIG. 2). On the rotor cup 2, a recess 10 corresponding to the projection 8 is also arranged in the rotor cup 2 with at least one turning moment-transmitting counter-area 11 (see FIGS. 3 and 4). The projection 8 engages in the corresponding recess 10 of the rotor cup 2, and thereby forms the positive-locking connection for the transmission of the turning moment.

According to this presentation, the rotor cup 2 is provided with one through hole 14, which at the same time forms the recess 10 for the projection 8 along with a socket 12 for the permanent magnet 7. This embodiment is able to be produced in a particularly simple manner, and also enables a simple assembly and a simple installation and removal of the permanent magnet 7. It is also particularly advantageous that, through the through hole 14, the coupling device 6 is less vulnerable to dirt, such as clinging fiber particles, or these can be removed in a more simple manner through the through hole 14.

The through hole 14 may be carried out as a cylindrical bore hole, such that at the same it can serve the purpose of centering the rotor cup 2 on the rotor shaft 4. As such, in most cases, the projection 8 of the rotor shaft 4 is likewise formed in a cylindrical shape. Thereby, the cylindrical projection 8 extends into the center of mass of the rotor cup 2; a particularly good centering can take place through this.

As can be seen in FIG. 1, the recess 10 of the rotor cup 2 thereby features a first section 10*a*, which in this case is formed as a cylinder, along with a second section 10*b*, which includes at least one turning moment-transmitting counter-area 11. Likewise, according to this presentation, the rotor shaft 4 features a first section 8*a*, which is cylindrical, along with a second section 8*b*, which is turned towards the shaft end turned away from the rotor cup, and which includes one or more turning moment-transmitting areas 9, which can be formed as surfaces or edges.

While it is advantageous for the first section 10*a* of the recess 10 and for the first section 8*a* of the projection 8 to form this as a cylinder, the second section 8*b* of the projection 8, or the second section 10*b* of the recess 10, may feature differing contours, in order to provide one or more turning moment-transmitting surfaces or areas 9. Thereby, it is advantageous if the second section 10*b* or the second section 8*b* is formed with a size as small as possible relative to the longitudinal axis of the spinning rotor, in order to avoid imbalances in operation.

Figure 2:
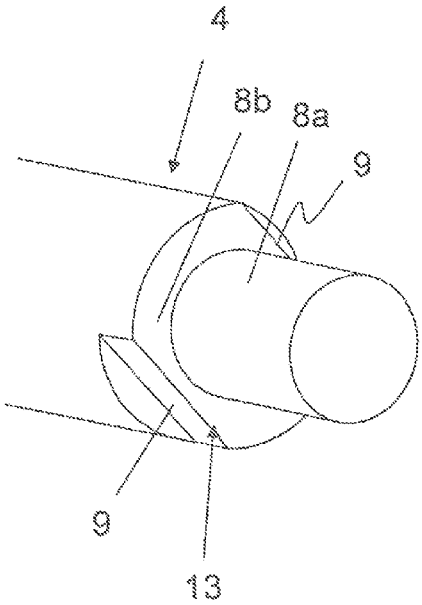

FIG. 2 shows a first embodiment of a projection 8 on a rotor shaft 4 with a first section 8*a* and a second section 8*b*. As described above, the first section 8*a* is cylindrical, while the second section 8*b* includes a width across flats 13. Thereby, the second section 8*b* provides two turning moment-transmitting areas 9 that are located opposite each other.

Figure 3:
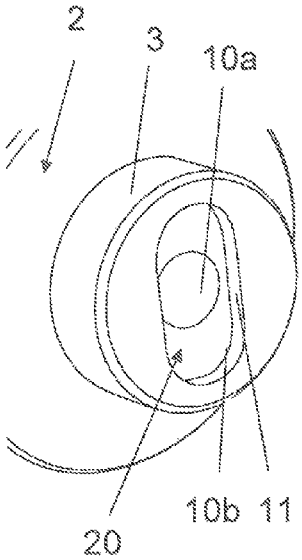

FIG. 3 shows a rotor cup 2, which can be assembled with the rotor shaft 4 of FIG. 2 at an open-end spinning rotor 1, and which features a recess 10 with a first section 10*a* and a second section 10*b*. Thereby, the first section 10*a* is formed in a manner corresponding to the projection 8*a* as a cylindrical bore hole. As described in FIG. 1, the cylindrical bore hole may thereby be formed as a through hole 14, and may include the socket 12 for the permanent magnet. However, the first section 10*a* may also be formed as a blind hole. In this case, the second section 10*b* is formed as a groove 20 and provides two turning moment-transmitting surfaces or counter-areas 11, which can work together with a width across flats 13 of the projection 8 from FIG. 2. Thereby, in terms of production technology, the groove-shaped, second section 10*b* is advantageously arranged on the reverse side of the opening of the rotor cup 2 on the truss 3 of the rotor cup 2.

Figure 4:
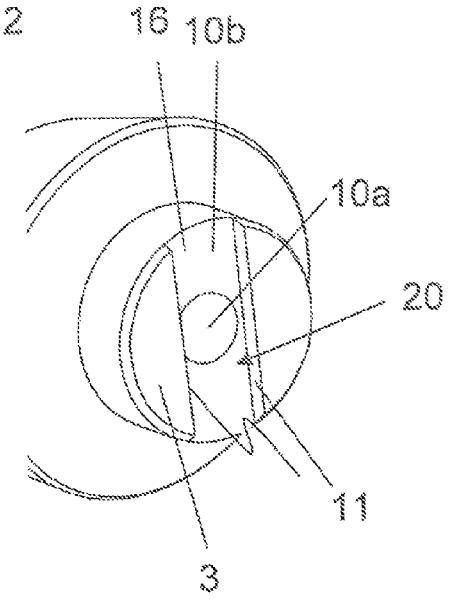

FIG. 4 shows an alternative embodiment of a rotor cup 2, which, just like the recess 10 shown in FIG. 3, features a first section 10*a* and a second section 10*b*. In contrast to the presentation in FIG. 3, the second section 10*b* is designed as a groove 20 extending across the entire width of the truss 3 of the rotor cup 2, which also includes two turning moment-transmitting counter-areas 11. Such a recess 10 may be manufactured in a particularly simple manner.

Figure 5:
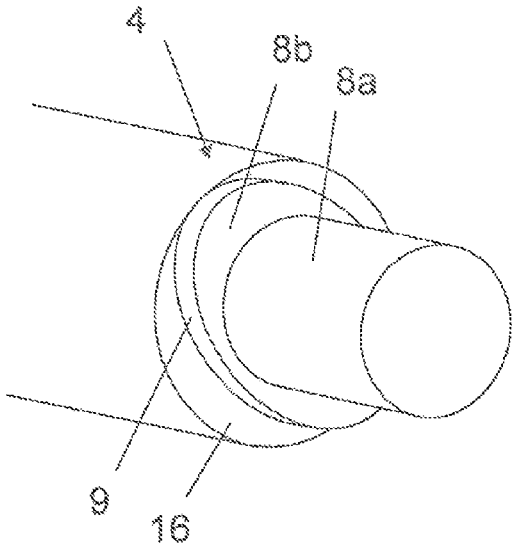

FIG. 5 shows another embodiment of a rotor shaft 4 with a projection subdivided into a first section 8*a* and a second section 8*b*. The first section 8*a* is in turn formed as a cylinder, while the second section 8*b* features an elliptical outer contour, the circumferential surface of which forms the at least one turning moment-transmitting area 9. In this case, the rotor cup 2 (not shown here) includes, just like that shown in FIG. 3, a recess 10 with a first section 10*a*, which is designed in cylindrical form, and a second section 10*b*, which, just like the presentation in FIG. 3, is designed in elliptical form.

Thereby, it is obvious that a great number of variations are possible with regard to the design of the second section 8*b* of the projection 8 and/or the second section 10*b* of the recess 10. The second section 8*b* of the projection 8 may also include a square or an oval (similar to the form shown in FIG. 3) or a polygon. Furthermore, it is also possible (for example, in the variation of FIG. 2) to, instead of a width across flats 13, level off only one side of the second section 8*b* of the projection 8, such that only one turning moment-transmitting area 9 is also available.

Figure 6:
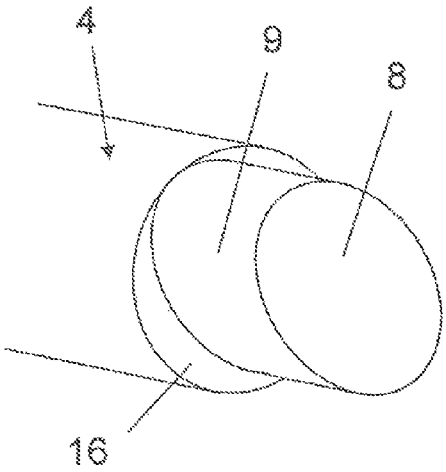

FIG. 6 shows a further embodiment of the invention, but with which a projection 8 on a rotor shaft 4 features only one section. According to this presentation, the projection 8 is made in an elliptical form and, in an elliptical bore hole that is not shown, engages a rotor cup 2, which may be produced, for example, by milling. Thus, with the projection in FIG. 6 as well, only one turning moment-transmitting area 9 is provided. Of course, by way of derogation from the presentation that is shown, the projection 8 of the rotor shaft 4 may also have an oval shape.

Figure 7:
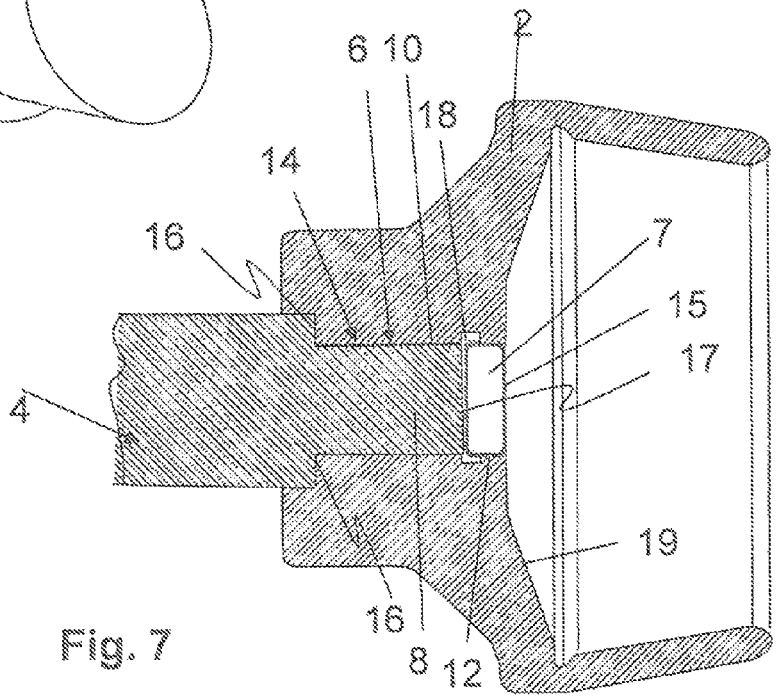

FIG. 7 shows a rotor cup 2 with a part of the rotor shaft 4 in a detailed presentation. As can be seen in FIG. 7, the rotor cup 2, just like the rotor shaft 4, features one axial stop surface 16, such that, upon the assembly of the open-end spinning rotor, after reaching the stop surfaces 16, the rotor cup 2 in relation to the rotor shaft 4 is automatically correctly positioned in an axial direction. Moreover, according to the presentation in FIG. 7, the permanent magnet is arranged in a socket 12, which is formed by a through hole 14 of the rotor cup 2. The end of the rotor shaft 4 turned towards the rotor cup 2 thereby forms a positioning surface 17 for the permanent magnet 7, such that, after the assembly of the open-end spinning rotor 1, this likewise must only be pressed or clipped into the through hole 14 or its socket 12, and is automatically positioned in an axial direction.

According to this presentation, the socket 12 for the permanent magnet includes a circumferential groove 18. If the permanent magnet 7 includes a plastic lining cover 15, due to the deformation of the elastic plastic lining cover 15, a sufficient stop of the permanent magnet 7 can be achieved just through simply pressing the socket 12. A positive-locking stop also partially arises due to the deformation of the plastic lining cover 15.

However, instead of the plastic lining cover 15, the permanent magnet 7 can also be equipped with a special mount that is not shown, for example a metallic holder, by means of which it can be clipped into the socket 12.

Figure 8:
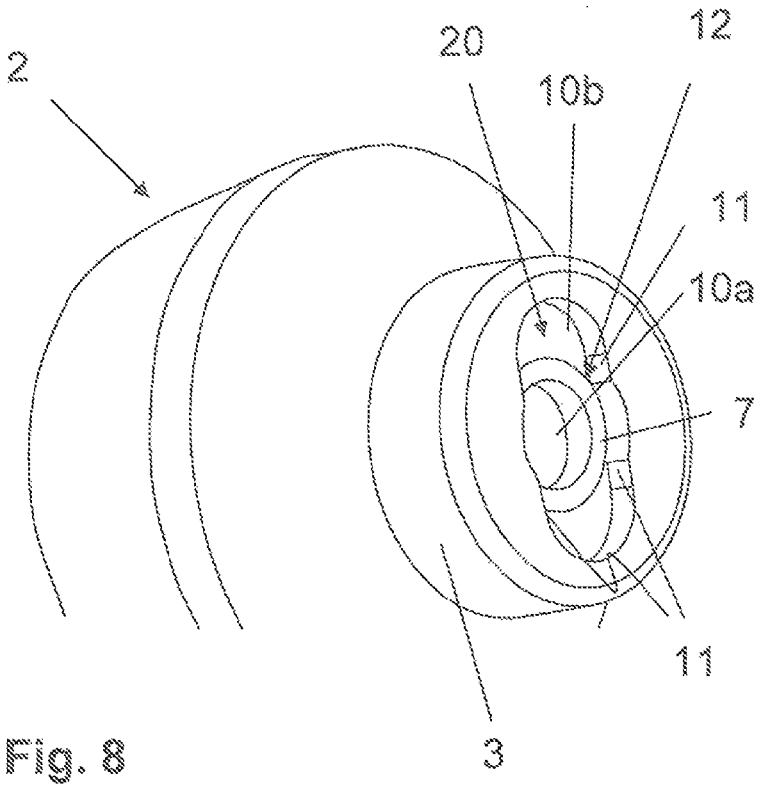
Figure 9:
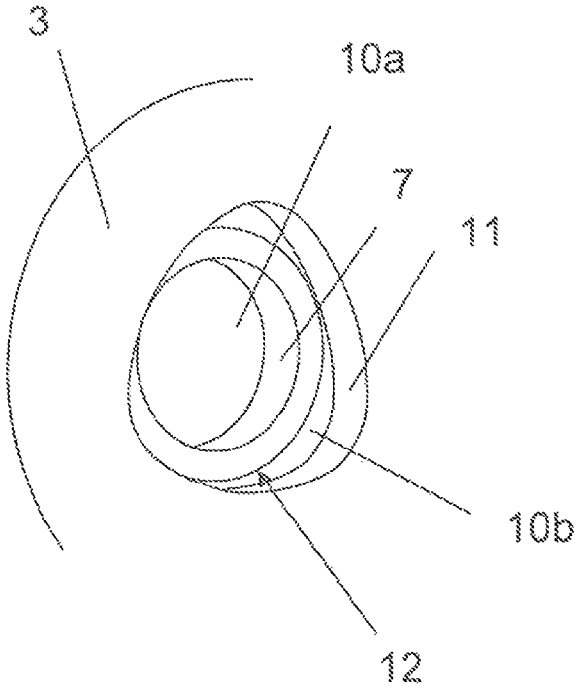

According to another embodiment of the invention, as it is shown in FIGS. 8 and 9, a ring magnet is arranged as a permanent magnet 7 in the truss 3 of the rotor cup 2. For this purpose, the rotor cup 2 is equipped with a through hole 14 formed as a stepped bore hole, whereas, according to these presentations, the larger diameter of the stepped bore hole forms the socket 12 for the ring-shaped permanent magnet 7. Thereby, it is preferable to, as shown in FIGS. 8 and 9, insert the ring magnet from the side of the truss 3 into the rotor cup 2. With this embodiment, the permanent magnet 7 may be formed slightly larger than with the arrangement in FIG. 7, such that a particular good axial stop arises. Preferably, the ring magnet at the same time at least partially forms the first section 10*a* of the recess 10 in the rotor cup, in which the projection 8 or the second section 8*b* of the projection 8 of the rotor shaft 4 is able to be fixed. The ring magnet is arranged directly behind the second section 10*b* of the recess 10 forming the turning moment-transmitting counter-areas 11.

According to FIG. 8, the second section 10*b* of the recess 10 of the rotor cup 2 thereby includes a groove 20, as shown in FIG. 3, whereas, however, the turning moment-transmitting counter-areas 11 are interrupted by the socket 12 for the permanent magnet 7, such that, in this case, four turning moment-transmitting counter-areas 11 are then formed. For this embodiment, the projection 8 of the rotor shaft 4 corresponds to that shown in FIG. 2.

A ring magnet as a permanent magnet 7 is also shown in FIG. 9; however, the second section 10*b* of the recess 10 of the rotor cup 2 is formed in the shape of a rounded polygon, here a rounded triangle. With this embodiment, it is advantageous that several (here, three) positions are provided for the assembly of the rotor shaft 4 in the rotor cup 2. Moreover, the production of such a rounded polygon is possible without any problem by milling, both for the recess 10 and for the projection 8. As such, by way of derogation from the presentation that is shown, it would also be possible to carry out the entire recess 10 and/or the entire projection 8 in polygonal form, in a manner similar to the embodiment shown in FIG. 6. The permanent magnet 7 would then in turn be arranged in an axial extension of the projection 8.

For the two embodiments of FIGS. 8 and 9, with one through hole 14, it is in turn advantageous that the bore hole on the rotor cup 2 is open to the rotor bottom 19 and, as such, that any impurities do not stick to the coupling device 5 between the projection 8 of the rotor shaft and the ring magnet, but can be led away by the through hole 14. Furthermore, the rotor cup 2 may be designed in a form smaller than with an embodiment for which the permanent magnet 7 is arranged in an axial extension of the projection 8.

Figure 10:
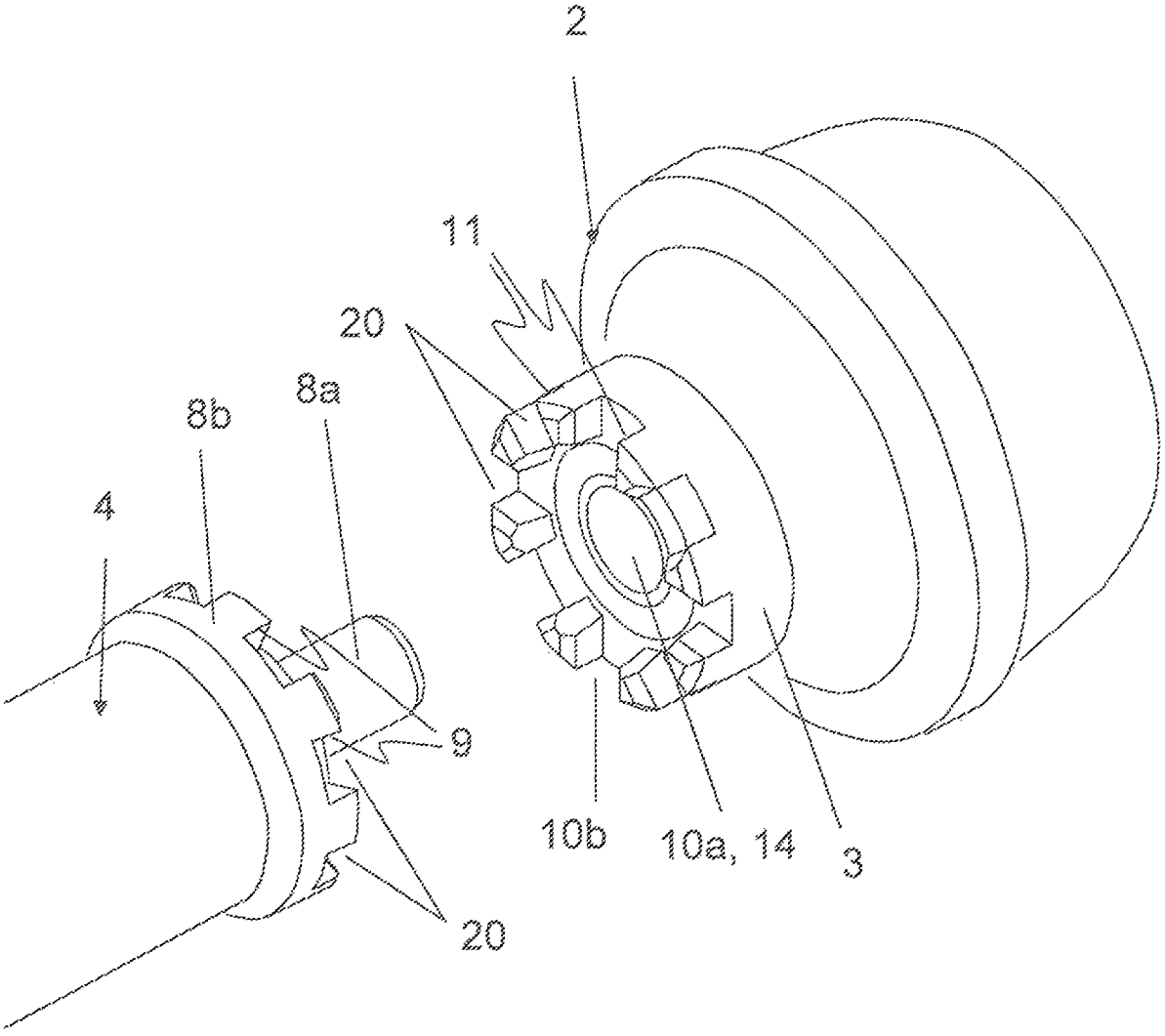

An additional embodiment of a coupling device 6 is shown in FIG. 10. As with that in FIG. 1, the rotor cup 2 may be equipped with a through hole 14, which may form the socket 12 (not visible) for the permanent magnet 7 (also not visible). Likewise, the through hole 14 at the same time also serves the purpose of centering the rotor cup 2 at the rotor shaft 4 by means of the projection 8 and/or the first section 8*a* of the projection 8. Likewise, as with the example of the rotor cups of FIGS. 1 and 3, the recess 10 of the rotor cup 2 also thereby features a first section 10*a*, which in this case is formed through the through hole 14 as a cylinder, along with a second section 10*b*, which includes the at least one turning moment-transmitting counter-area 11. Of course, with this embodiment, the first section 10*a* could be formed as a blind hole instead of the through hole 14, in order to receive the permanent magnet 7 and to center the rotor shaft 4.

In this case, the second section 10*b* of the recess 10 of the rotor cup includes several grooves 20, which in this case are each arranged at a 30° angle to each other, and which feature at least one turning moment-transmitting area 9. These grooves 20 may be inserted radially in a simple manner by means of a milling cutter. In a similar manner, the second section 8*b* of the projection 8 of the rotor shaft 4 includes several grooves 20, which in this case are arranged at a 30° angle to each other, and which contain at least one turning moment-transmitting area 9. The grooves 20 thereby extend across the entire width of the truss 3 of the rotor cup 2, such that production is further simplified.

For such an embodiment with multiple grooves 20, it is advantageous that, upon the assembly of the rotor cup 2 on the rotor shaft 4, the rotor cup must be rotated only slightly, until the projection 8 and/or the several ridges remaining between the grooves 20 and forming the projection 8 engage in the grooves 20 of the recess 10 of the rotor cup 2. However, it is also possible with this embodiment to provide only one or two grooves 20 on the rotor cup 2 and then, on the rotor shaft, produce bridges corresponding to these as projections or projections 8 by milling. Furthermore, it is also possible to provide more than three grooves 20.

Depending on the design of the grooves 20, the turning moment-transmitting areas 9 of the projection 8 and the turning moment-transmitting counter-areas 11 of the recess 10 can be formed by the side spaces of the grooves 20 or solely by the finished edges of the grooves 20.

Furthermore, with this embodiment, an axial stop surface 16 and a positioning surface 17 for the permanent magnet 7 can also be designed as described in FIG. 7, such that reference is made to the embodiments therein.

The invention is not limited to the presentations shown in the embodiments. In particular, instead of one projection and one recess, as is presented in most of the embodiments, several projections can also be arranged on the rotor shaft, which correspondingly work together with several recesses on the rotor cup. The invention also includes additional variations and combinations within the framework of the patent claims, to the extent technically possible and reasonable.

The invention claimed is:

1. An open-end spinning rotor, comprising:

a rotor cup;

a rotor shaft;

a coupling device configured between the rotor cup and the rotor shaft such that transmits a turning moment from the rotor shaft to the rotor cup and detachably connects the rotor shaft and the rotor cup;

a magnetic axial coupling between the rotor cup and the rotor shaft;

the rotor shaft comprising a projection with a turning moment transmitting area defined thereon;

the rotor cup comprising a recess with a shape corresponding to the projection and a turning moment transmitting counter-area defined therein, wherein the projection fits into the recess for detachably coupling the rotor shaft and the rotor cup;

a socket defined in a bottom or within a truss of the rotor cup for receipt of a permanent magnet component of the magnetic axial coupling; and wherein the projection comprises first section at an end towards the rotor cup, and a second section axially aligned with the first section, the turning moment transmitting area defined in the second section.

2. The open-end spinning rotor as in claim 1, wherein the socket is defined as an axial extension of the recess.

3. The open-end spinning rotor as in claim 1, wherein the permanent magnet is a ring magnet.

4. The open-end spinning rotor as in claim 1, wherein the socket is formed by a bore hole in the rotor bottom.

5. The open-end spinning rotor as in claim 1, wherein the projection comprises a cylindrical outer contour at the first section.

6. The open-end spinning rotor as in claim 1, wherein the projection comprises one of an elliptical or oval outer contour at the second section.

7. The open-end spinning rotor as in claim 1, wherein the turning moment transmitting area is formed by a groove defined in the second section.

8. The open-end spinning rotor as in claim 1, wherein the turning moment transmitting area is formed by at least one flat defined in an outer contour of the second section.

9. The open-end spinning rotor as in claim 1, wherein the recess is defined by a cylindrical through hole in the rotor bottom, and the socket is a section of the cylindrical through hole.

10. The open-end spinning rotor as in claim 1, wherein the first section of the projection comprises a first cylindrical section, the recess comprising a first cylindrical section in which the first cylindrical section of the projection engages, and a second section that includes the turning moment transmitting counter-area and in which the second section of the projection engages.

11. The open-end spinning rotor as in claim 10, wherein the rotor cup comprises a truss extending axially away from the rotor bottom, the second section of the recess defined in the truss.

12. The open-end spinning rotor as in claim 11, wherein the second section of the recess comprises a groove that extends across the truss.

13. The open-end spinning rotor as in claim 1, wherein the socket is defined by a through hole in the rotor bottom, the permanent magnet clipped into the through hole.

14. The open-end spinning rotor as in claim 1, wherein the permanent magnet comprises a plastic lining cover that fixes the permanent magnet within the socket.

15. The open-end spinning rotor as in claim 1, further comprising an axial stop surface defined between the rotor cup and the rotor shaft for axial positioning of the rotor cup on the rotor shaft.

16. The open-end spinning rotor as in claim 1, wherein the rotor shaft comprises a ferromagnetic material at the projection.

17. A rotor cup for an open-end spinning rotor, the rotor cup configured to detachably couple with a rotor shaft, wherein the rotor shaft has a projection with a first section at an end thereof, and a second section axially aligned with the first section and having a turning moment transmitting area defined therein, the rotor cup comprising:

a permanent magnet disposed in a socket so as to define a magnetic axial coupling with the rotor shaft when the rotor cup is coupled to the rotor shaft;

a recess comprising a first section with a shape corresponding to the first section of the projection, the recess comprising a second section axially aligned with the first section of the recess and having a transmitting counter-area shape corresponding to the turning moment transmitting area of the second section of the rotor shaft projection; and wherein upon coupling the rotor cup to the rotor shaft, the second section of the rotor shaft projection engages in the second section of the recess.

18. The rotor cup as in claim 17, wherein the socket is defined as an axial extension of the recess.

19. The rotor cup as in claim 17, wherein the permanent magnet is a ring magnet.

20. The rotor cup as in claim 17, wherein the socket is defined by a through hole in the rotor cup.

21. The rotor cup as in claim 20, wherein the permanent magnet is clipped into the through hole.

22. The rotor cup as in claim 17, wherein the first section of the recess comprises a cylindrical shape so as to correspond to a cylindrical outer contour of the first section of the rotor shaft.

23. The rotor cup as in claim 17, wherein the second section of the recess comprises one of an elliptical or oval shape.

24. The rotor cup as in claim 17, wherein the recess is defined by a cylindrical through hole in a bottom of the rotor cup, and the socket is a section of the cylindrical through hole.

25. The rotor cup as in claim 10, further comprising a truss extending axially away from a bottom of the rotor cup, the second section of the recess defined in the truss.

26. The rotor cup as in claim 25, wherein the second section of the recess comprises a groove that extends across the truss.

27. The rotor cup as in claim 17, wherein the permanent magnet comprises a plastic lining cover that fixes the permanent magnet within the socket.

* * * * *